United States Patent [19]

Teruyama

[11] 4,259,045

[45] Mar. 31, 1981

[54] GEAR PUMP OR MOTOR UNITS WITH SLEEVE COUPLING FOR SHAFTS

[75] Inventor: Hideo Teruyama, Shobu, Japan

[73] Assignee: Kayabakogyokabushikikaisha, Tokyo, Japan

[21] Appl. No.: 963,329

[22] Filed: Nov. 24, 1978

[51] Int. Cl.[3] ..... F03C 2/08; F04C 2/18; F04C 11/00

[52] U.S. Cl. ..... 418/200; 418/212; 418/213; 29/156.4 R; 403/6

[58] Field of Search ..... 418/70, 200, 212–214; 403/6, 7; 29/156.4 R

[56] References Cited

U.S. PATENT DOCUMENTS

| | | | |
|---|---|---|---|
| 2,750,891 | 6/1956 | Berry | 418/200 |
| 2,751,846 | 6/1956 | Lapsley | 418/200 |
| 3,101,673 | 8/1963 | Clark et al. | 418/200 |
| 3,291,052 | 12/1966 | Weaver et al. | 418/200 |

*Primary Examiner*—John J. Vrablik
*Attorney, Agent, or Firm*—Saul Jecies

[57] ABSTRACT

A gear pump or motor wherein at least two pump or gear units are arranged in coaxial relationship and have their axially inwardly extended driven and driving shafts journalled in a common intermediate casing, the driving shafts being splined together with an internally splined sleeve. The inlet port opened in the intermediate casing is communicated through low-pressure passages with the pump chambers of the respective pump or motor units (and with the assembly chamber or pocket formed to accommodate the opposing ends of the axially inwardly extended driving shafts). The diameter of the inlet port is made larger than the size of the sleeve for interconnecting the driving shafts so that the sleeve may be inserted through the inlet opening into the assembly chamber or pocket and interconnect the driving shafts. Thus, in assembly the interconnection between the driving shafts may be much facilitated. Furthermore, the correct axial alignment between them may be ensured because the axially inwardly extended driven and driving shafts are journalled in common holes or bores, respectively.

4 Claims, 4 Drawing Figures

GEAR PUMP OR MOTOR UNITS WITH SLEEVE COUPLING FOR SHAFTS

BACKGROUND OF THE INVENTION

The present invention relates to means for facilitating the spline interconnection between the opposing ends of the axially inwardly extended driving shafts of driving gears of coaxialy disposed pump or motor units and more particularly improvements in or relating to gear pumps or motors, whereby in assembly the correct axial alignment and spline connection between the opposing driving shafts thereof may be facilitated.

The gear pump comprising two pump units which are substantially indentical in structural and functional features is disclosed in as for example U.S. Pat. No. 3,101,673, granted to H. M. Clark et al, Aug. 27, 1963 (British Pat. No. 982,014). Each pump unit comprises a casing member and a cover member, and a pair of intermeshing gears are disposed in the pumping chamber defined in the casing member. The axially outwardly extended shafts of the driven and driving gears are journalled in the cover member while the axially inwardly extended shafts thereof are journalled in the casing member itself. The radial mating surfaces of the two casing members are formed with recesses, which define a space when assembled, and with axial holes or bores for receiving locating or dowel pins. The two pump units are assembled together with the axially inwardly extended driving shafts into the space splined to each other with an internally splined sleeve.

The gear pump or motor of the type described above has some defects. First, when the opposing driving shafts are splined together, they must be correctly aligned in coaxial relationship. Consequently, the shaft holes or bores of the casing members must be correctly aligned. To this end, the locating holes and locating or dowel pins must be machined with a higher degree of accuracy so that highly skilled and experienced operators, high-precision machines and many machining steps are inevitably required, thus resulting in the increase in manufacturing cost. Second, in order to spline the driving shafts to each other with the internally splined sleeve, two separate or split casing members must be used and aligned correctly with respect with each other with the use of locating or dowel pins. As a result, the number of parts is increased, resulting in the increase both in material and fabrication costs.

SUMMARY OF THE INVENTION

Accordingly, one of the objects of the present invention is to provide an improved gear pump or motor wherein the correct axial alignment and spline interconnection between the axially inwardly extended or opposing driving shafts of the driving gears of two coaxial pump or motor units may be much facilitated.

Another object of the present invention is therefore to provide an improved gear pump or motor wherein the axially inwardly extended or opposing driving shafts of the two pump or motor units are journalled in a common shaft hole or bore extended through an intermediate casing which, in one embodiment of the present invention, is interposed between first and second gear pump casing each accommodating a pair or intermeshing driven and driving gears and their axially outwardly extended shafts.

To the above and other ends, briefly stated, the present invention provides a gear pump or motor which comprises at least two pump or motor units and wherein the axially outwardly extended or opposing driving shafts of the driving gears of the two pump or motor units are journalled in a common intermediate casing and spline connected to each other with an internally splined sleeve. The common casing has an inlet port which is communicated through low-pressure passages with the pump chambers in the two pump or motor units (and with an assembly chamber of space into which are extended the externally splined inner ends of the opposing driving shafts). The diameter of the inlet port is made greater than the outer dimensions of the sleeve so that the latter may be inserted through the inlet opening into the assembly chamber or space and connected to the inner ends of the driving shafts. Thus the interconnection between the inner ends of the opposing driving shafts with the internally splined sleeve may be much facilitated. Furthermore, since the axially inwardly extended or opposing driving shafts are journalled in a common shaft hole or bore extended through the common intermediate casing, the correct axial alignment between them may be easily attained and maintained.

The above and other objects, features and advantages of the present invention will become more apparent from the following description of some preferred embodiments thereof taken in conjunction with the accompanying drawings.

BRIEF DESCRIPTION OF THE DRAWINGS

Same reference numerals are used to designate similar parts throughout FIGS. 1 and 2; in FIG. 3 the same reference numeral as used in FIGS. 1 and 2 plus 100 is used to designate a part similar to that shown in FIGS. 1 and 2; and in like manner, the same reference numeral used in FIGS. 1 and 2 plus 200 is used to designate a part similar to that shown in FIGS. 1 and 2.

DESCRIPTION OF THE PREFERRED EMBODIMENTS

The present invention will be described as being applied to a gear motor, but it is to be understood that it may be equally applied to gear motors.

Figure 1:
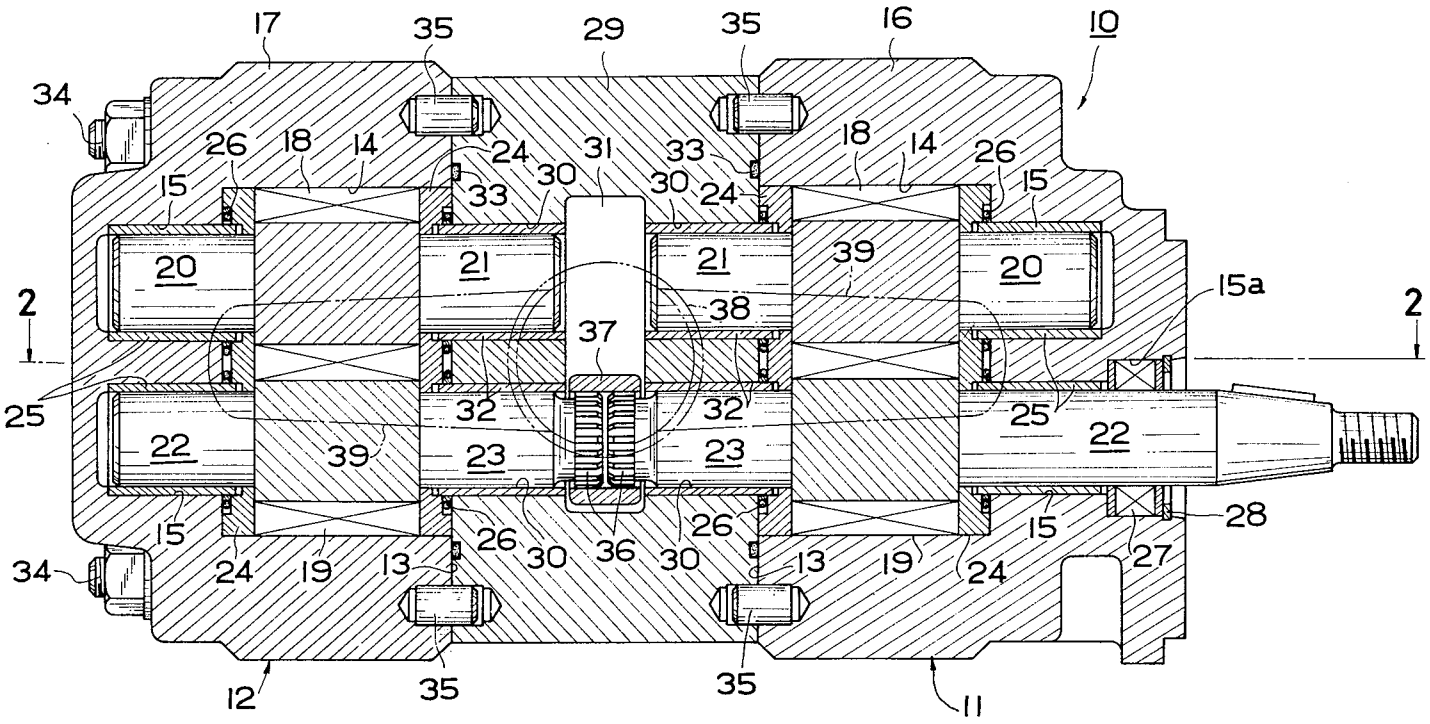
FIG. 1 is a cross-sectional view taken in a first plane through a pump incorporating the principles of the present invention.
Figure 2:
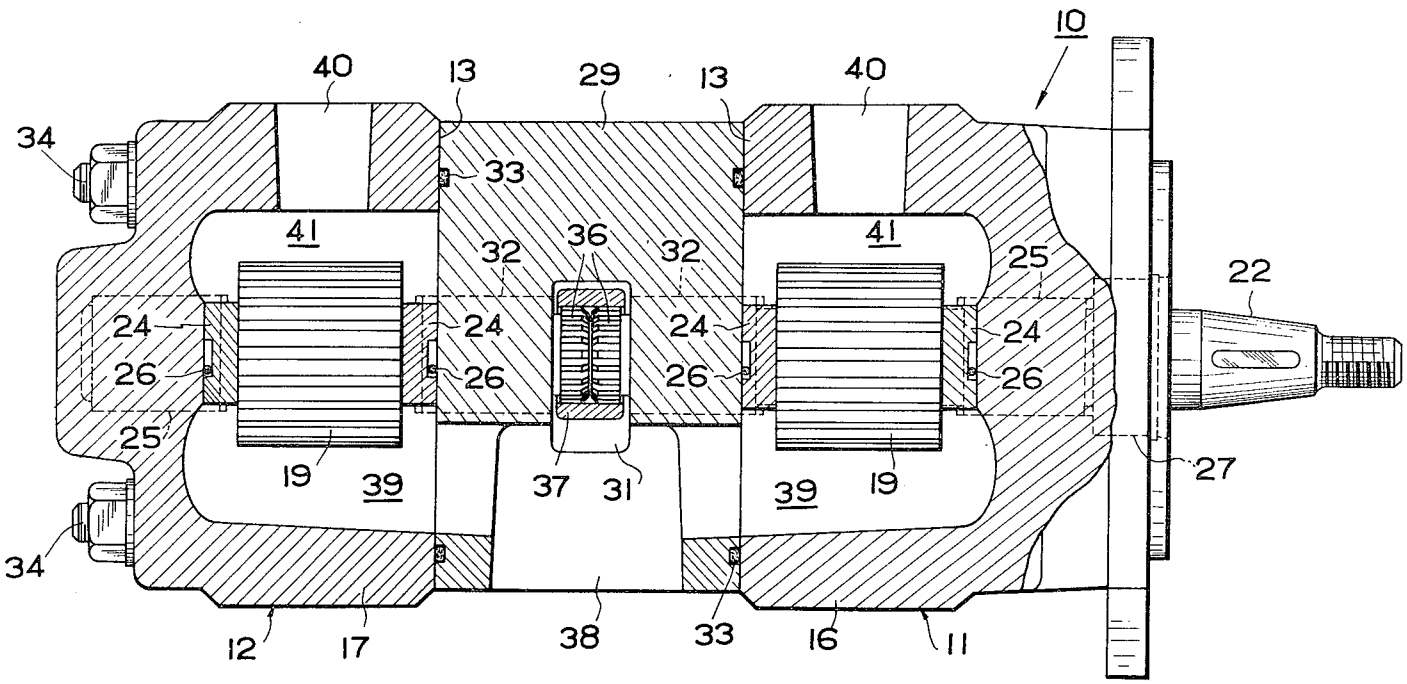
FIG. 2 is a cross-sectional view taken in a second plane at right angles to the first plane of the first embodiment shown in FIG. 1.

First Embodiment, FIGS. 1 and 2

Referring to FIGS. 1 and 2, a gear pump 10, to which is applied the present invention, is of the two unit construction having a first pump unit 11 and a second pump unit 12, both of which are substantially similar in construction and operation to each other.

The first and second pump units 11 and 12 have radial mating surfaces 13, each of which is formed with a recess in the form of a figure eight which defines a pump chamber 14. Blind holes or bores 15 of receiving the axially outwardly extended shafts 20, and 22 of two pairs of intermeshing impeller gears or driven and driving gears 18 and 19 are formed axially and in parallel with each other in the bottoms or the closed radial ends of the pump chambers 14. Bushings 25 are pressed into these blind holes or bores 15. The hole or bore 15 for journalling the driving shaft 22 of the driving gear 19 of the first pump unit 11 is extended axially through the first casing 16.

Each pair of intermeshing driven and driving gears 18 and 19 are disposed for rotation in the pump chamber 14 with their shafts 20, and 22 journalled in the bushings 25. The shafts 20 and 21 are referred to as the driven shafts while the shafts 22 and 23, as the driving shafts. In order to liquid-tightly seal the side faces of the intermeshing gears 18 and 19, pressure plates 24 are pressed against them in such a way that the pressure plates 24 may be slidable along the shafts 20–23. Since the construction of these pressure plates 24 is of the conventional type and does not constitute the present invention, it will suffice only to explain that, as with the conventional ones, the rear surface of each of them has a high pressure zone and a low pressure zone which are separated from each other by seals 26 and which are communicated with the high and low pressure sides of the pump during operation, whereby the pressures exerting to the pressure plates 24 may be balanced and the pressure plates 24 may effectively liquid-tightly steal the side faces of the intermeshing gears 18 and 19.

The drive shaft 22 of the driving gear 19 of the first pump unit 11 is extended axially through the hole or bore 15 beyond the first casing 16 and is drivingly coupled to an exterior prime mover (not shown). In order to seal this driving shaft 22, an oil seal assembly 27 is placed in and securely held in position with a snap ring 28 in a counterbore **15*a* of the hole or bore 15**.

An intermediate casing 29, which is interposed between the first and second casings 16 and 17, is formed with two axial through holes or bores 30 for receiving therein the shafts 21 of the driven gears 18 and the driving shafts 23 of the driving gears 19. The two axial through holes or bores 30, which are in parallel with each other, are communicated with each other through an assembly chamber 31. Bushings 32 for journalling the shafts 21 and 23 are pressed into these holes or bores 30 and their inner ends are axially spaced apart from each other by the assembly chamber 31. The first and second casings 16 and 17 and the intermediate casing 29 are assembled together with through bolts 34 and nuts. In this case, the body seals 33 are interposed between the radial mating surfaces of the first and second casings 16 and 17 on the one hand and those of the intermediate casing 19 on the other hand, and locating pins 35 are inserted into aligned blind holes formed in the mating surfaces of the first, second and intermediate casings 16, 17 and 29 as shown.

With the above construction, the driven shafts 21 of the driven gears 18 and the driving shafts 23 of the driving gears 19 are journalled by the bushings 32 press fitted into the axial through holes 30 of the intermediate casing 29. Since these axial through holes or bores 30 may be simultaneously machined with a higher degree of accuracy, the driven shafts 21 of the driven gears 18 and the driving shafts 23 of the driving gears 18 may be accurately aligned with each other in the axial through holes or bores 30. Furthermore, the locating or dowel pins 35 serve to attain and maintain the correct alignment between the first, second and intermediate casings 16, 17 and 29, whereby the correct alignments between the axial through holes 30 in the intermediate casing 29 and the holes or bores 15 in the first and second casings 16 and 17.

In order to transmit the driving power from the prime mover (not shown) through the first pump until 11 to the second pump unit 12, the inner opposing ends of the driving shafts 23 of the first and second driving gears 19 are extended into the chamber 31 externally splined and connected to each other through an internally splined sleeve 37. Thus, the single prime mover (not shown) may simultanesouly drive both the first and second pump units 11 and 12.

In assembly, the sleeve 27 is inserted through an inlet port 38 formed in the intermediate casing 29 and opened at one side wall thereof as best shown in FIG. 2. The inlet port 38 is communicated not only with the chamber 31 in the intermediate casing 29 but also low-pressure passages 39 which are extended in parallel with the axes of the intermeshing driven and driving gears 18 and 19 through the first, second and intermediate casings 16, 17 and 29.

Two outlet ports 40 are formed through the side walls of the first and second casings 16 and 17 on the opposite side of the inlet port 38 as best shown in FIG. 2. These outlet ports 40 are in communication with high pressure passages 41 extended through the first and second casings 16 and 17 in parallel with the axes of the intermeshing gears 18 and 19.

The low pressure passage 39 are communicated with the pump chambers 14 in opposed relationship with the portions at which the driven and driving gears 18 and 19 disengage from each other. In like manner, the high pressure passages 41 are communicated with the pump chambers 14 in opposed relationship with the portions at which the driven and driving gears 18 and 19 intermesh each other as is well known in the gear pump and motor techniques.

The inner diameter of the inlet port 38 is larger than the outer diameter of the internally splined sleeve which interconnects the driving shafts 23 of the driving gears 19 of the first and second pump units 11 and 12 so that, as described hereinbefore, in an assembly line an operator may insert the sleeve 37 through the inlet port 38 into the communication chamber or passage 31 and have it engaged with the shafts 23 so as to interconnect them.

Next the mode of operation of the gear pump 10 with the above construction will be described. As the intermeshing gears 18 and 19 are driven, the liquid is sucked through the inlet port 38, flows through the low pressure passages 39, is impounded in the spaces between the teeth of the intermeshing driven and driving gears 18 and 19, carried around the casings 16 and 17 into the high pressure passages 41 and then discharged through the outlet ports 40.

Figure 3:
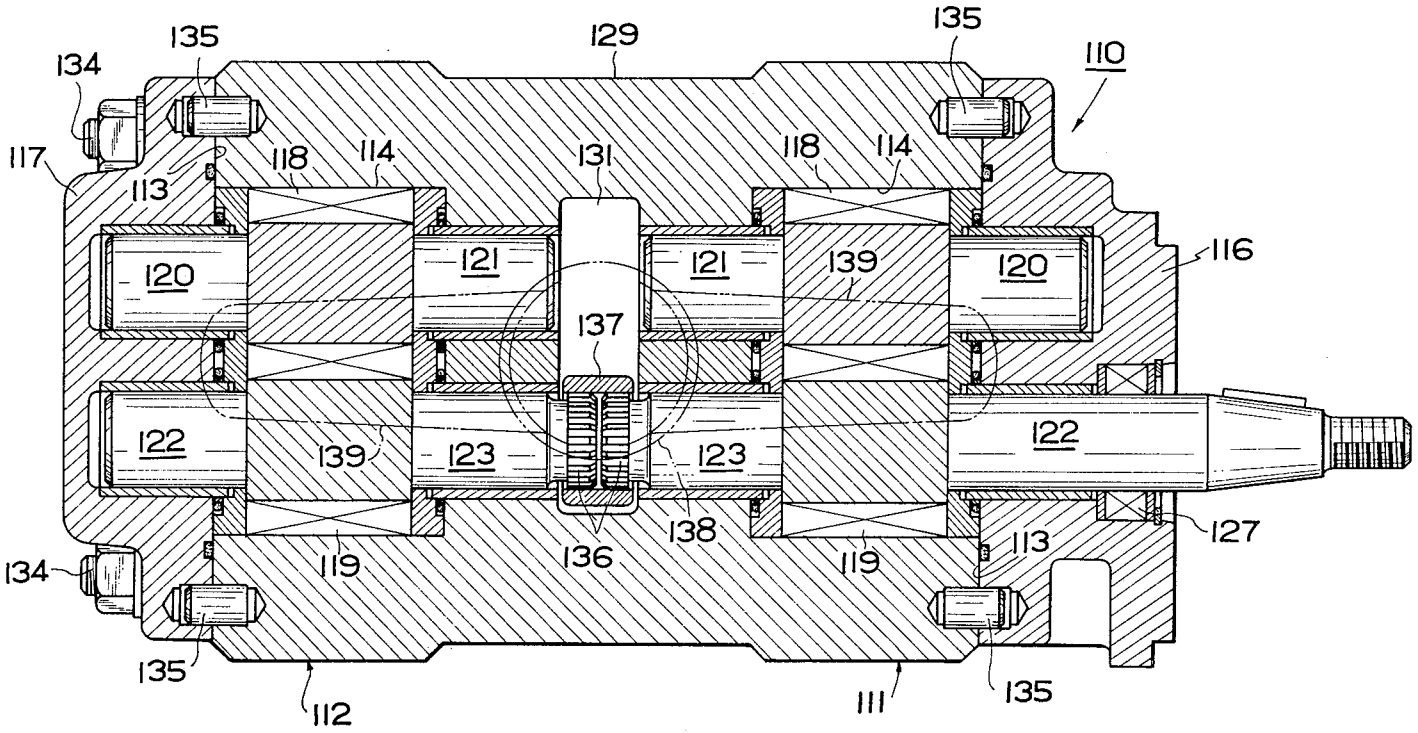
FIGS. 3 and 4 are cross-sectional views, respectively, of second and third embodiments of the present invention.

Second Embodiment, FIGS. 3

The second embodiment shown in FIG. 3 is substantially similar in construction and mode of operation to the first embodiment described above with reference to FIGS. 1 and 2 except that the first and second casings 16 and 17 are formed integral with the intermediate casing 29 as a unitary construction and the outer shafts of the intermeshing gears are journalled in the cover members securely and liquid-tightly attached to the casing.

More particularly, a gear pump 110 of the second embodiment has two pump units 111 and 112 and has a pump housing consisting of a pump casing 129 and cover members 16 and 17 securely and liquid-tightly attached to the ends of the casing 129. Pump chambers 114 are recessed in the end surfaces of the casing 129 for accommodating therein the intermeshing driven and driving gears 118 and 119. The cover members 116 and 117 are formed with the holes or bores for receiving therein the outwardly extended shafts 120 and 122 of the driven and driving gears 118 and 119. The above description will suffice to distinguish the second embodiment from the first embodiment so that no further description shall be made.

The second embodiment is also advantageous in that the connection and correct alignment between the driving shafts 123 of the driving gears 119 of the first and second pump units 111 and 112 may be much facilitated.

Figure 4:
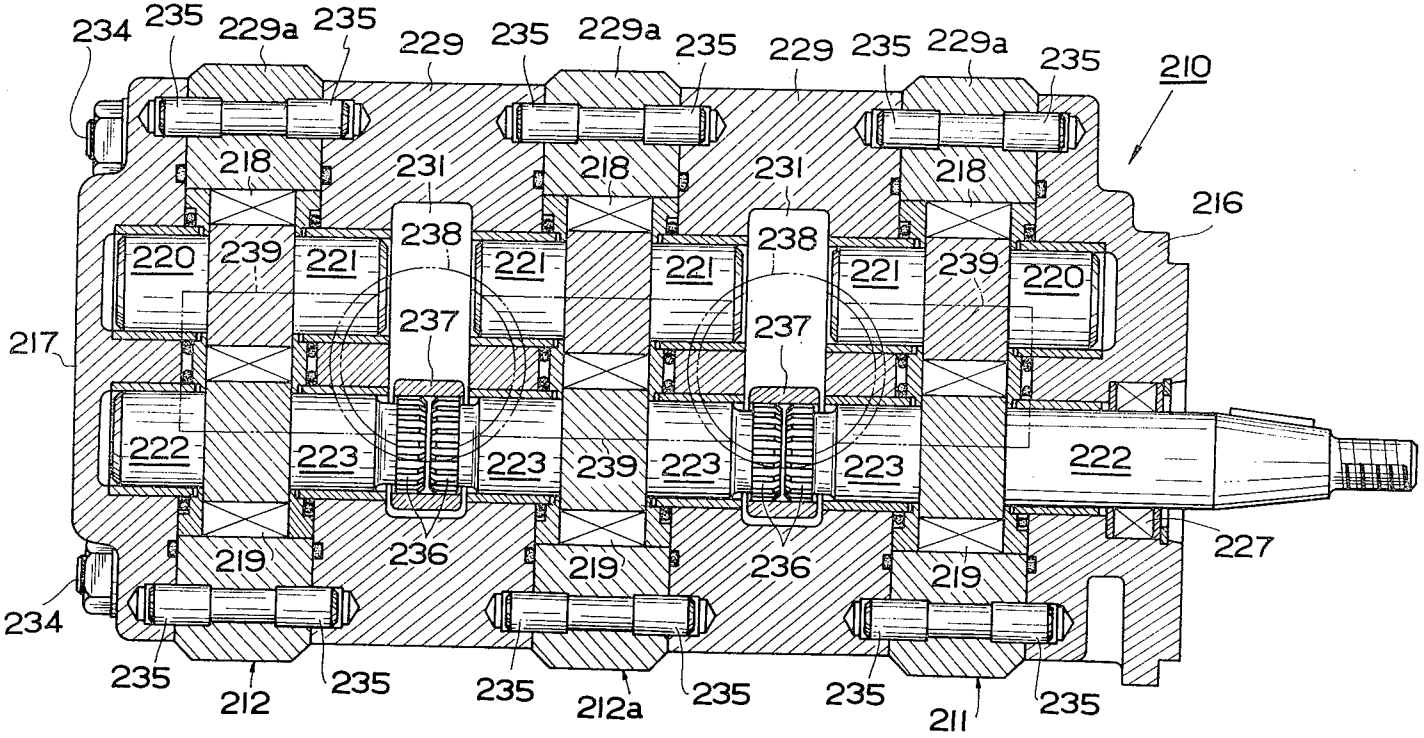

Third Embodiment, FIG. 4

The third embodiment shown in FIG. 4 has three pump units 211,212 and 213, but it is to be understood that the number of pump units may be increased as many as desired as will become apparent from the following description. The third embodiment is substantially similar in construction to the first embodiment of FIGS. 1 and 2 except that the first or second casing 16 or 17 is splitted into a cover member 216 or 217 and a pump chamber casing 229*a* and a pump chamber casing 229*a* is interposed between the intermediate casings 229. As with the second embodiment shown in FIG. 3, the cover members 216 and 217 are adapted to the outwardly extended shafts of the driven and driving gears of the outermost pump units 211 and 212. The pump chamber casing 229*a* which has a pump chamber 214 for accommodating a pair of intermeshing driven and driving gears 218 and 219 is adapted to be interposed between the cover member 216 or 217 and the intermediate casing 229 or between the intermediate casings 229. Thus it is readily seen that the number of pump units may be increased as many as desired.

However, in the third embodiment, when the width of the driven and driving gears 218 and 219 is short and consequently the width of the pump chamber casing 229*a* is short, it sometimes become difficult to open the discharge or outlet ports at the side wall of the pump chamber casing 229*a*. In this case as with the low-pressure passages the high pressure passages (not shown) are extended in parallel with the axes of the intermeshing gears 218 and 219 through the cover members 216 and 217 and the intermediate casings 229 and communicated with the discharge or outlet ports which are opened through the side walls of the cover members 216 and 217 and the intermediate members 229.

What is claimed is:

1. In a gear pump or a gear motor, a combination comprising at least two pump or motor unit casings each surrounding a pump or motor chamber for accommodating a pair of intermeshing driven and driving gears and shaft receiving holes or bores axially extended for journalling the outwardly extended shafts of said intermeshing gears; an intermediate one piece casing adapted to be interposed between said two pump or motor unit casings and formed with two axially extended through holes or bores adapted to journal the inwardly extended shafts of said intermeshing gears, one of said two axially extended through holes or bores being adapted to journal both the inwardly extended shafts of the driven or driving gears and the other being adapted to journal both the inwardly extended shafts of the driving or driven gears; a common inlet port in said intermediate casing communicated through low-pressure passages with the pump or motor chambers in said pump or motor unit casings and an assembly chamber or opening communicated with both said two axial through holes or bores intermediate their ends and with said common inlet port, and a sleeve which is smaller than said inlet port and said assembly chamber or opening and which may be inserted through said common inlet port into said assembly chamber or opening so as to interconnect the opposing ends of said inwardly extended shafts of said driving gears.

2. A combination as set forth in claim 1, wherein said pump or motor chamber of each of said pump or motor unit casings is defined as a recess formed in the radial mating surface thereof and adapted to be joined to the radial mating surface of said intermediate casing.

3. A combination as set forth in claim 1, wherein each of said pump or motor unit casings is split into a pump or motor chamber casing having a pump chamber defined therein and a cover member adapted to journal said outwardly extended shafts of said driven and driving gears and securely and liquid-tightly attached to said pump or motor chamber casing, and a desired number of combinations of said pump or motor chamber casings and said intermediate casings is interposed between the outermost pump or motor chamber casings.

4. In a gear pump or a gear motor, a combination comprising two pump or motor unit casings each surrounding a pump or motor unit chamber for accomodating a pair of intermeshing driven or driving gears, said pump or motor casings comprising a one piece casing formed with two axially extended through holes or bores adapted to journal the inwardly extended shafts of said intermeshing gears, one of said two axially extended through holes or bores beng adapted to journal both the inwardly extended shafts of the driven or driving gears and the other being adapted to journal both the inwardly extended shafts of the driving or driven gears; a common inlet port in said one-piece casing communicated through low-pressure passages with the pump or motor chambers in said pump or motor unit casings and an assembly chamber or opening communicated with both said two axial through holes or bores intermediate their ends and with said common inlet port, and a sleeve which is smaller than said inlet port and assembly chamber or opening and which may be inserted through said common inlet port into said assembly chamber or opening so as to interconnect the opposing ends of said inwardly extended shafts of said driving gears and wherein said pump or motor chambers are defined as recesses formed in the radial mating surfaces of said one-piece casing adapted to mate with the corresponding radial mating surfaces of cover members.

* * * * *